United States Patent [19]

Miller

[11] Patent Number: 5,035,470

[45] Date of Patent: Jul. 30, 1991

[54] SIDE PANEL CONVERSION KIT FOR A DESK

[75] Inventor: Regis R. Miller, Burlington, N.J.

[73] Assignee: Stylex, Inc., Delanco, N.J.

[21] Appl. No.: 435,160

[22] Filed: Nov. 13, 1989

[51] Int. Cl.[5] ..... A47B 41/00

[52] U.S. Cl. ..... 312/195; 312/265.6

[58] Field of Search ..... 312/265.5, 265.6, 194, 312/195, 196

[56] References Cited

U.S. PATENT DOCUMENTS

| | | | |
|---|---|---|---|
| 3,105,726 | 10/1963 | Jung | 312/195 |
| 3,408,137 | 10/1968 | Vincens | 312/195 |
| 3,883,196 | 5/1975 | Mohr | 312/194 |
| 4,103,981 | 8/1978 | Donahue et al. | 312/195 |
| 4,258,963 | 3/1981 | Fusselman et al. | 312/194 |

*Primary Examiner*—Kenneth J. Dorner
*Assistant Examiner*—Gerald A. Anderson
*Attorney, Agent, or Firm*—Stuart E. Beck

[57] ABSTRACT

A side panel conversion kit for a desk for providing a side panel that extends to the floor. It includes an outer panel which is connected to the legs of the desk adjacent the existing side panel or pedestal, and an inner panel which is connected to the lower portion of the side panel.

17 Claims, 4 Drawing Sheets

SIDE PANEL CONVERSION KIT FOR A DESK

FIELD OF THE INVENTION

This invention relates to desks and more particularly to a kit which converts a side panel that extends part way to the floor to one that extends all the way to the floor.

From time to time, it is necessary or desirable to change the apperance of furniture in an office. Thus, as styles change it is desirable to be able to convert furniture such as desks and the like having open or partially open side panels to closed side panels.

To this extent, a kit for converting a desk from an open panel design to a closed panel design which could be installed on site by the owner or user would be advantageous since the conversion could be made at relatively low expense and at the convenience of the owner.

Briefly, the side panel conversion kit comprises a side panel assembly which is adapted to overlie the existing side panel where there is no pedestal or to overly the side panel of the pedestal. It includes that the panel can slidably engage the legs to closely underly the underside of the desk top and extends to the floor. A panel is provided for a portion of the inner surface of the side panel.

BRIEF DESCRIPTION OF THE DRAWING

The invention will be better understood and further advantages and uses thereof will be readily apparent when considered in view of the following detailed description of exemplary embodiments, taken with the accompanying drawing in which.

DESCRIPTION OF THE PREFERRED EMBODIMENT

Figure 1:
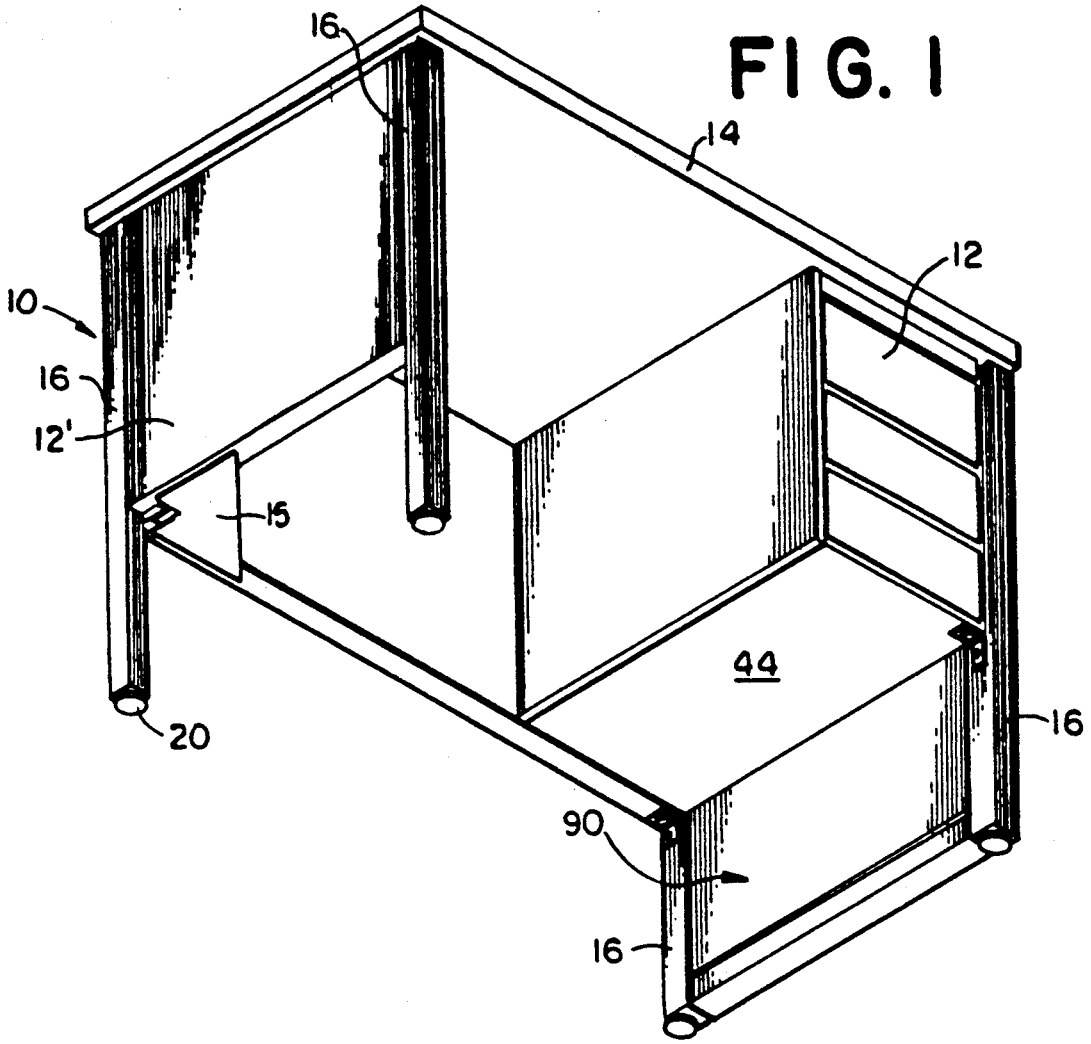
FIG. 1 is a three-quarter view looking upward at a single pedestal desk of the type which can be converted by the invention.

Referring to FIG. 1 a desk 10 having one pedestal 12 which may include drawers and a side panel 12' and back panel 13 is illustrated. The desk 10 comprises a top 14 from which the pedestal 12 and side panel 12' depend. The tops of side panel 12' and back panel 13 are connected to the desk top 14. Their bottoms are connected to each other by a gusset 15. The pedestal 12 and side panel 12' support legs 16 as illustrated in FIGS. 1 and 3.

Figure 3:
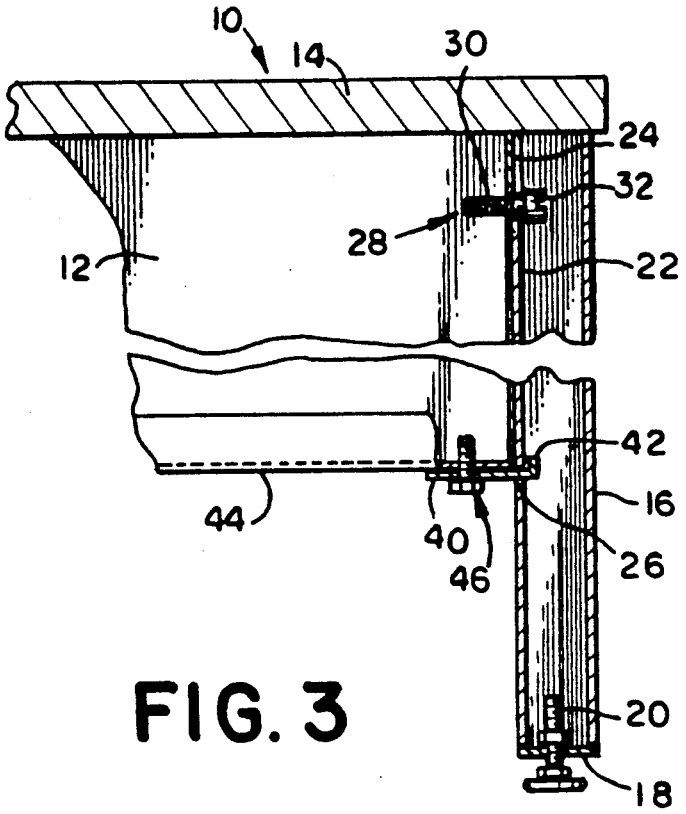
FIG. 3 is a section view showing the manner in which the legs are assembled to the pedestal of a desk

As illustrated in FIG. 3 a typical leg 16 is a hollow member generally square in cross section which may be comprised of steel, aluminum or the like. Its lower end includes a cap 18 with a threaded opening through which an adjustable leveling pad member 20 is threadably received.

At its upper end, the inner wall 22 of each leg 16 includes an upwardly facing U-shaped notch 24. At its mid-portion inner wall 22 includes an opening 26. The upwardly facing notch 24 and opening 26 cooperate to connect leg 16 to the desk.

The legs 16 are connected to the pedestal 12 by a screw or other suitable element 28 having a shaft 30 and a head 32 is threadingly received in the pedestal sidewall. The head 32 is spaced from the sidewall of the pedestal 12 a distance which is the same as the thickness of inner wall 22. This enables the shaft 30 to be received in notch 24 with inner wall 22 retained between the sidewall of the pedestal and head 32 to retain the upper end of leg 16 against the pedestal.

As best seen in FIG. 3 the midportion of the leg 16 is retained against the pedestal 12 by an elongated clip 40, the distal end 42 of which is upturned and extends through opening 26 in the inner wall 22 of leg 16. The other end of clip 40 is connected to the underside 44 of the pedestal 12 by a removable threaded fastener such as screw 46.

Figure 8:
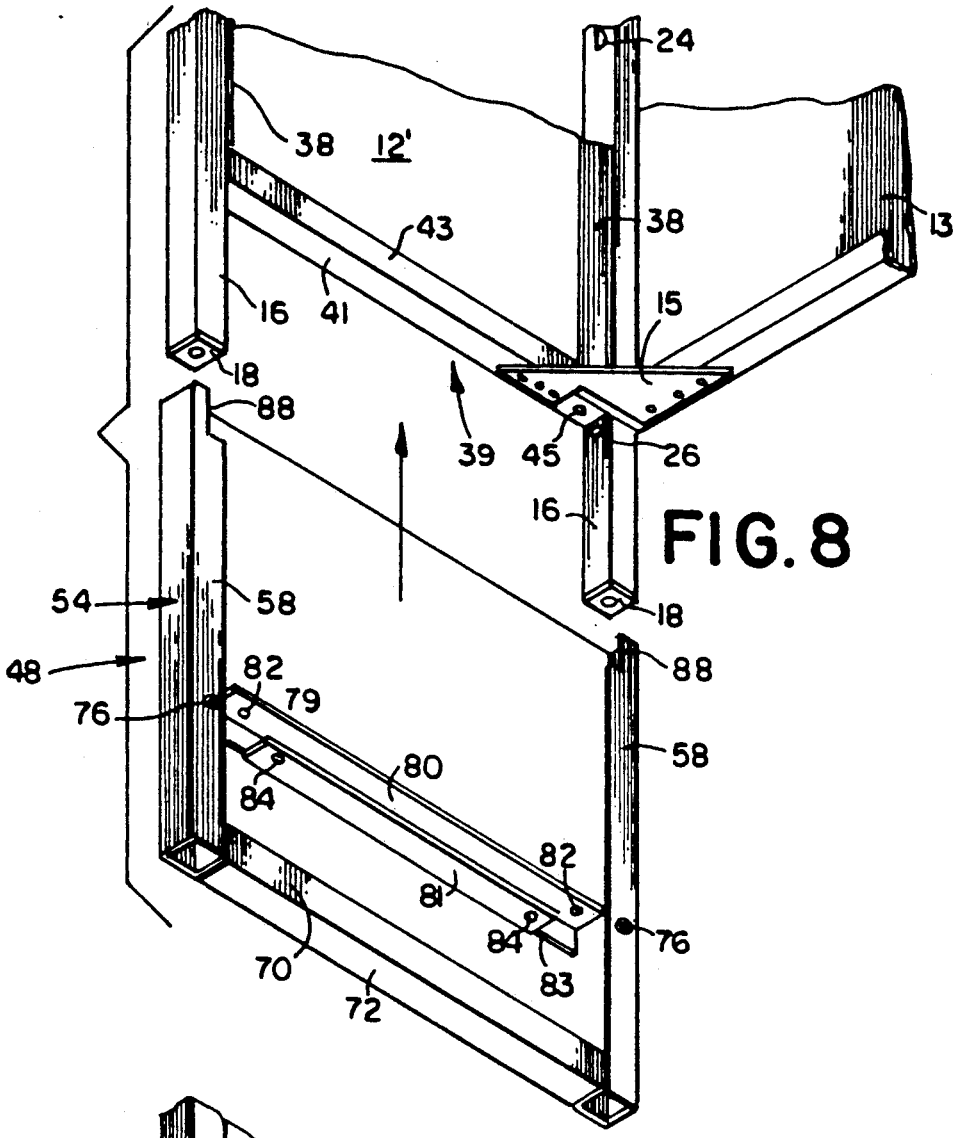
FIG. 8 is a view of the inner surface of a side panel constructed in accordance with the invention showing its manner of installation to the side of a desk that does not have a pedestal.

As seen in FIG. 8, the end panel 12' includes inwardly facing flanges 38 on its lateral edges and an inwardly facing channel 39 at its lower edge. The channel 39 includes a web 41 and an upwardly directed wall 43.

Each of the inwardly facing flanges 38 includes an opening (not shown) into which a screw similar to screw 28 is threaded.

The upper portion of legs 16 are retained against the inwardly facing flanges 38 by engagement of the aforementioned screws with the notch 24 on the inner wall 22 in the same manner as legs 16 are connected to pedestal 12.

The mid-portion of legs 16 are connected to panel 12' by the elongated clip 40 the distal end 42 of which extends through opening 26 on leg 16 and the other end which is connected to the opening 45. The clip 40 has been omitted from FIG. 8 for clarity, however, its configuration and installation can be clearly seen in FIGS. 3 and 6.

The kit of the invention provides a side panel assembly 48 which extends from the underside of the desk top 14 to the floor adjacent the bottom of legs 16.

Figure 2:
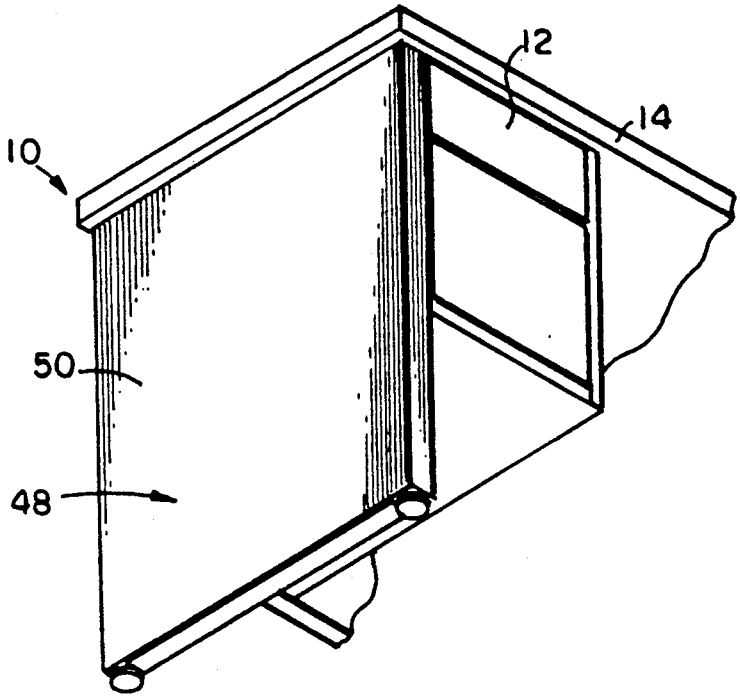
FIG. 2 is a three-quarter view of one of the side panels of a desk which has been converted by the invention.
Figure 4:
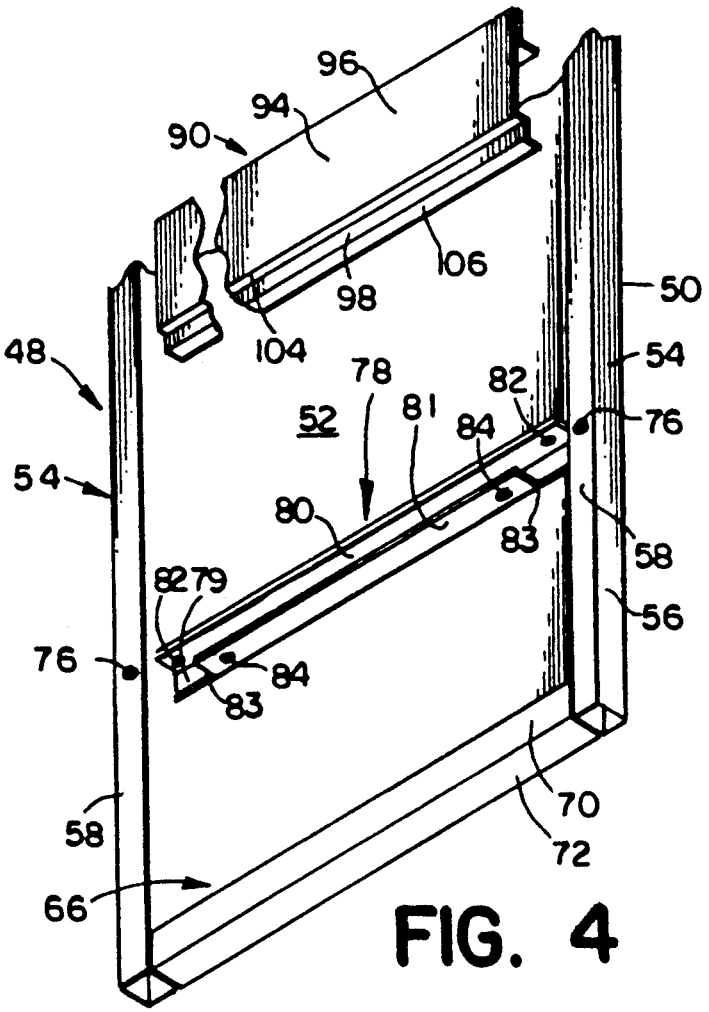
FIG. 4 is a perspective view showing the inner surface of a side panel constructed in accordance with the invention.

As best seen in FIGS. 2 and 4 the side panel assembly 48 may be comprised of a suitable material such as sheet metal. Preferably, it is the same color and finish as the other parts of the desk. The outer portion 50 of the side panel assembly 48 includes an inner surface 52 having two laterally spaced inwardly directed channel members 54.

Figure 7:
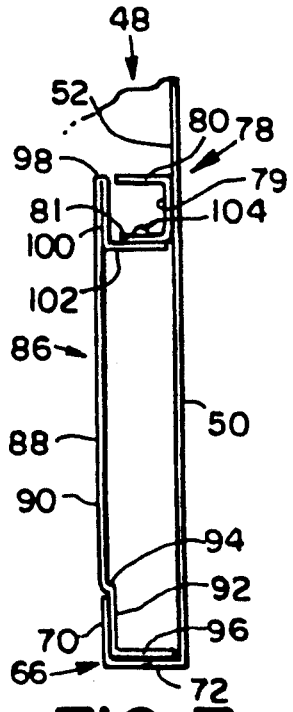
FIG. 7 is a detailed view in section of another part of a panel constructed in accordance with the invention.

Preferably, each channel member 54 is formed by folding the lateral edges of outer portion 50 to define webs 56 and walls 58. Web 56 extends between inner surface 52 and wall 58. As best seen in FIGS. 4 and 7 the lower most end of outer portion 50 comprises an inwardly facing channel 66 which includes an inner wall 70 and a web 72 which extends between the inner wall 70 and the outer portion 50.

The walls 58 include openings 76 which are in alignment with the openings 26 in the legs 16 as will be more fully explained below.

A suitable member such as horizontally extending channel 78 has its web 79 connected to the inner surface 52 of the side panel 50 and its legs 80 and 81 extending outwardly to about the same extent as the distance between the inner surface 52 and walls 58 of channel members 54.

Leg 80 of channel 78 is provided with an opening 82 at each end (FIG. 4). The ends of leg 81 are cut away to define notches 83. A plurality of openings 84 are disposed along leg 81.

Figure 5:
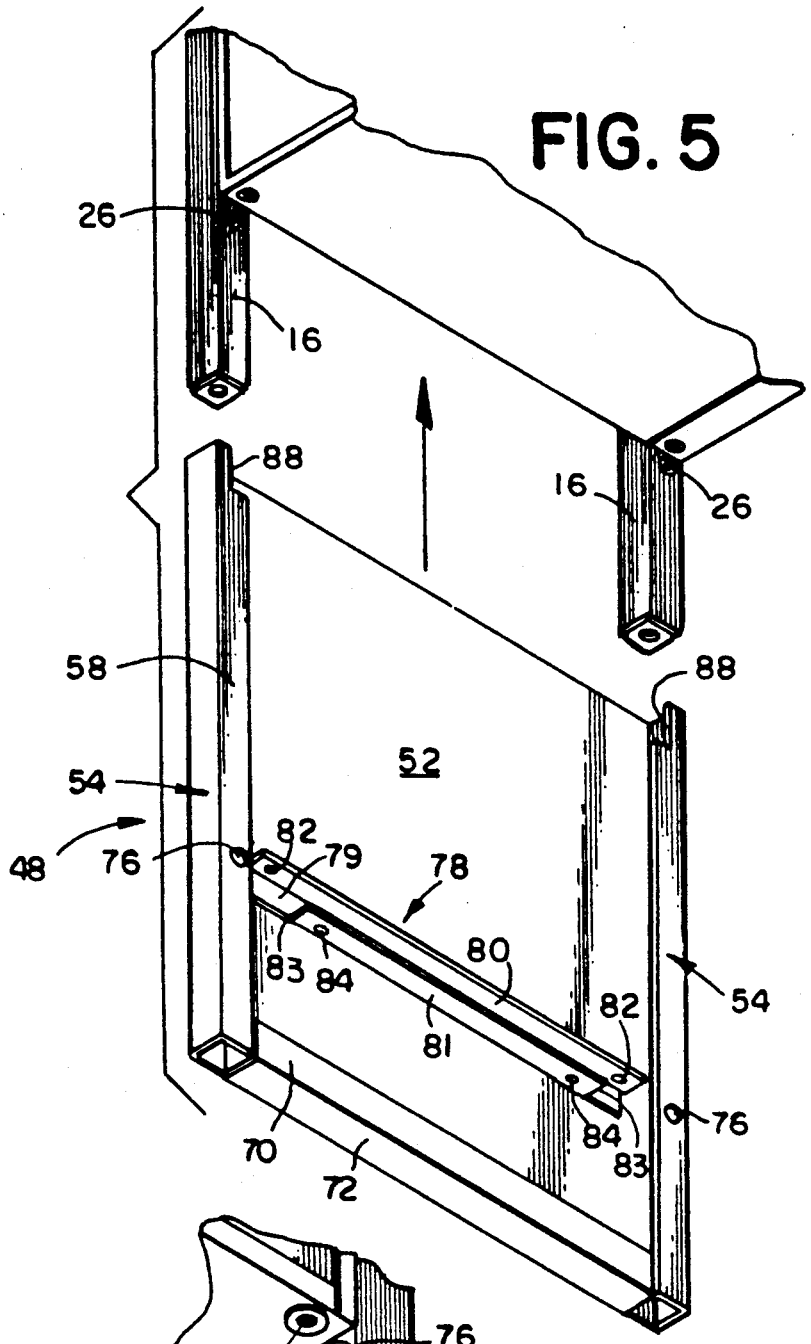
FIG. 5 is a view of the inner surface of a side panel constructed in accordance with the invention, showing its manner of installation on the pedestal side of a desk.

The upper end of walls 58 of the inwardly facing channels 54 comprise inwardly facing notches 88 as shown in FIG. 5.

The side panel assembly 48 also includes an inner panel 86 as shown in FIGS. 4 and 7. The inner panel 86 is generally channel shaped. It includes a web 88 which comprises first and second portions 90 and 92 which are connected by a ledge 94. The depth of ledge 94 is equal to the thickness of inner wall 70. The web 88 includes a lower end wall 96. The upper end of portion 90 is turned back on itself at 98 to define a skirt 100 having an inwardly directed upper end wall 102.

Preferably, upper end wall 102 has a plurality of upwardly directed dimples 104 which are spaced from each other a distance which is the same as the distance between the openings 84 in channel leg 81.

Figure 6:
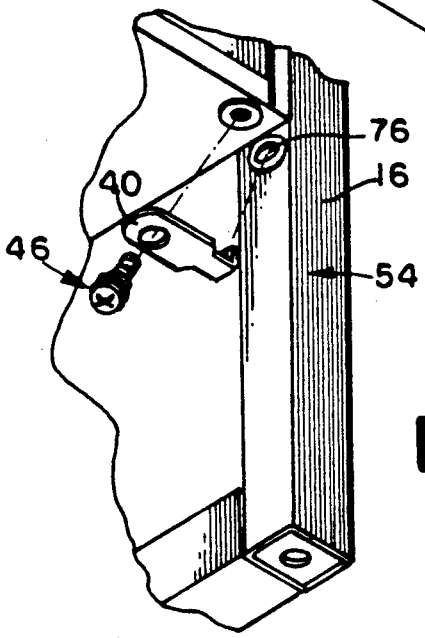
FIG. 6 is a three-quarter view showing how the desk legs are connected to a side panel constructed in accordance with the invention.

The manner in which the kit of the invention is used to convert the pedestal side of a desk can best be described by referring to FIGS. 5, 6, and 7.

The desk is inverted. Screws 46 and clips 40 which connect the legs 16 to the underside of the pedestal 12 are removed. The legs 16 then are separated from the screws 28 near the top of the pedestal 12. Screws 28 are backed away from the pedestal a distance sufficient to accomodate the thickness of channel walls 58 and inner wall 22. The legs 16 are then replaced with the screw heads 32 now loosely fitting in the notches 24 on each leg 16.

The outer portion 50 of the side panel is slipped over legs 16 so that the legs 16 are received in the inwardly facing channels 54 defined by the inner surface of the panel 50, web 56 and wall 58. When the upper end of the outer portion 50 is pressed into touching engagement with the underside of the desktop 14, leg 80 of channel 78 will lie against the bottom 44 of the pedestal 12. The earlier mentioned notches 88 provide clearance for screws 28.

Openings 76 in channel walls 58 are now in alignment with openings 26 in the legs 16 as seen in FIGS. 5 and 6. The clips 40 are now reconnected between the legs 16 and the underside 44 of the pedestal 12 by being inserted through openings 26 and 76 in the legs 16 and channels 54 respectively and being connected to the underside 44 of the pedestal 12 by screws 46.

The inner panel 86 can now be slipped into the recess defined by legs 16, channel 78 and the inner wall 70 of the channel 66. As seen in FIG. 7, the upper end wall 102 lies against channel leg 81 while the lower end wall 106 lies against web 72. The first portion 90 covers the space between channel legs 80 and 81 while the dimples 104 in the upper end wall 102 are received in the openings 84 in leg 81 to retain the inner panel 86.

A desk 10 with the side panel assembly 48 installed over the pedestal 12 is illustrated in FIGS. 1 and 2. Since the inner wall 70 is dimensioned to fit into the space created by second portion 92 and ledge 94, the inner panel 86 appears to flow continuously from somewhat above the pedestal 12 to the floor. On the other hand, as shown in FIG. 2 the outer portion of the side panel 50 extends from the desktop 14 to the floor.

Figure 9:
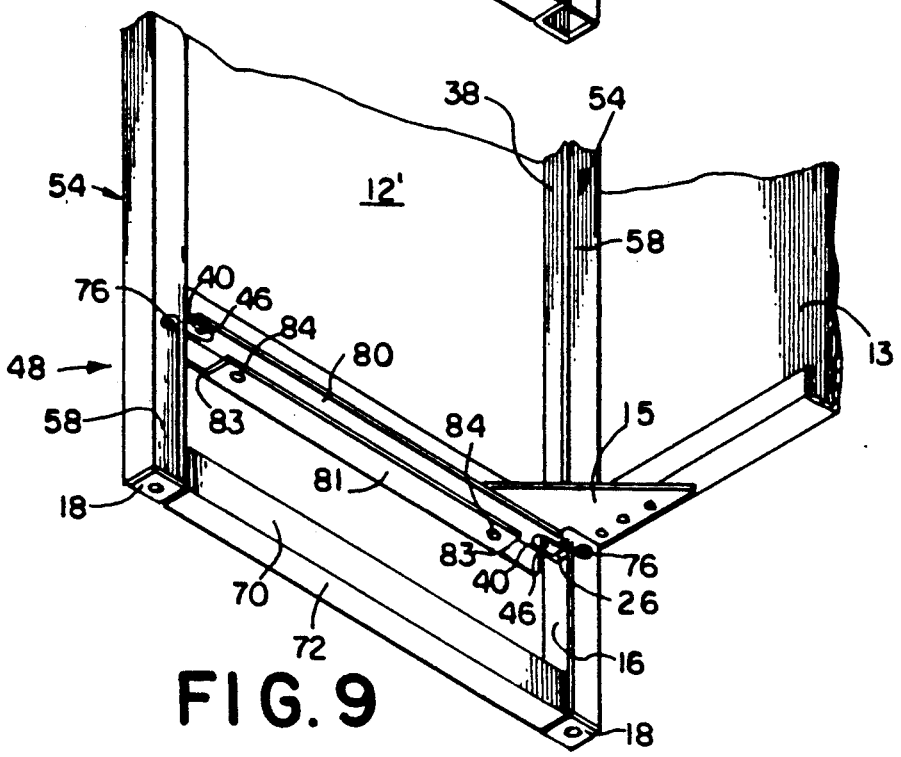
FIG. 9 is a three-quarter view showing how the side panel of the invention is connected to the side of a desk that does not have a pedestal.

Preferably the non-pedestal side of the desk is converted by the kit of the invention at the same time as the pedestal side is converted. The manner in which it is used can best be seen in FIGS. 8 and 9.

Thus, while the desk 10 is inverted, screws 46 are removed from openings 45 in web 41.

The outer portion 50 of the side panel 12' is slipped over legs 16 so that the legs are received in the inwardly facing channels 54 defined by the inner surface of the panel 50, web 56 and wall 58.

One of the channels 54 can easily slide between leg 16 and back panel 13 since they are not interconnected. The other channel 54 merely slips over the other leg 16.

The upper end of the outer portion 50 is pressed into touching engagement with the underside of the desk top 14 so that channel leg 80 lies against web 41 and with the clips 40 between them. The openings 82 in leg 80 are aligned with the openings 45 in web 41 and the openings in the clips 40. Screws 46 are then inserted through the openings 82 in flange 80, the openings in clips 40 and threaded into the openings 45 in web 41 to connect the panel 12' to the desk.

As explained earlier, the inner panel 86 may then be slipped into the recess defined by legs 16, channel 78 and inner wall 70 of the channel 66. This results in a side panel that extends from the desk top to the floor with the lower portion of the inner surface of the panel including the inner panel 86.

While the invention has been described with respect to a particular embodiment, it is apparent that other embodiments will be obvious to those skilled in the art in view of the foregoing description. Thus, the scope of the invention should not be measured by the description, but, rather by the scope of the claims appended hereto.

I claim:

1. A side panel conversion kit for a pedestal desk of the type having a pedestal and spaced legs which are connected to the desk by adjustable screw-like fasteners comprising a side panel assembly for overlying said pedestal, said side panel assembly including an outer portion and an inner portion, said outer portion having an outer surface, an inner surface and lateral edges, said outer portion including a first part for lying alongside said pedestal, and a second part for lying below said pedestal, elongated leg connection means coupled to said inner surface at said lateral edges, said elongated leg connection means being hollow to slidably receive said desk legs so that said side panel assembly is supported by said desk legs with said first part disposed adjacent said pedestal and said second part disposed below said pedestal, said inner portion for being disposed along the inner surface of the second part of said outer portion, means for supporting said inner portion, said means for supporting said inner portion comprising a first member disposed along the lower edge of said outer portion and a second member fixed to said inner surface of said outer portion in spaced relation to said first member, and said inner portion is dimensioned to fill the space defined by said elongated leg connection means and said first and second members.

2. A kit as defined in claim 1 wherein said elongated leg connection means comprise inwardly facing channels disposed along said lateral edges, each of said channels including a web connected to said inner surface and a wall connected to said web, and each of said walls includes an aperture for receiving a leg retaining member.

3. A kit as defined in claim 2 wherein said channels are comprised of the lateral edges of said outer portion so that they are not apparent from said outer surface.

4. A kit as defined in claim 1 wherein said first member comprises an upwardly directed leg which is coupled to said lower edge of said outer portion in facing relation to said inner surface, and said inner portion is releasably supported by said upwardly directed leg.

5. A kit as defined in claim 4 wherein said upwardly directed leg is coupled to said lower edge of said outer portion by a web.

6. An kit as defined in claim 4 wherein said inner portion is generally channel shaped and includes first and second legs with a web between them, one of said last named legs being for engagement with said upwardly directed leg and said other leg being for engagement with said second member.

7. A kit as defined in claim 6 wherein said second member includes a leg extending outwardly from said inner surface.

8. A kit as defined in claim 6 wherein said leg and said inner portion include mutually engagable means for retaining said inner portion in said space.

9. A kit for changing the appearance of a desk having an existing side panel that extends partway to the floor so that the side panel extends all the way to the floor, wherein the desk has spaced legs, comprising a second side panel for overlying said existing side panel, said second side panel including an outer surface, an inner surface and lateral edges, said second side panel including a first part for lying alongside said existing side panel, and a second part for lying below said existing side panel so as to extend all the way to the floor, and elongated leg connection means coupled to said inner surface at said lateral edges, said elongated leg connection means being hollow to slidably receive said desk legs so that said second side panel is supported by said desk legs with said first part disposed adjacent said existing side panel and said second part disposed below said existing side panel and extending all the way to the floor.

10. A kit as defined in claim 9 wherein said elongated leg connection means comprise inwardly facing channels disposed along said lateral edges, each of said channels including a web connected to said inner surface and a wall connected to said web, and each of said walls includes an aperture for receiving a leg retaining member.

11. A kit as defined in claim 10 wherein said channels are comprised of the lateral edges of said outer portion so that they are not apparent from said outer surface.

12. A kit as defined in claim 9 wherein said existing side panel includes a channel along its lower edge, a member fixed to said inner surface of said second side panel, said member including a leg extending outwardly from said inner surface for engagement with said last named channel.

13. A kit for changing the appearance of an existing side panel of a desk of the type having spaced legs comprising a second side panel for overlying said existing side panel, said second side panel including an outer surface, an inner surface and lateral edges, said second side panel including a first part for lying alongside said existing side, and a second part for lying below said existing side, elongated leg connection means coupled to said inner surface, at said lateral edges, an inner panel for being disposed along the inner surface of the second part of each second side panel, means for supporting said inner panel, said means for supporting said inner panel comprising a first member disposed along the lower edge of said second side panel and a second member fixed to said inner surface of said second side panel in spaced relation to said first member, and said inner panel is dimensioned to fill the space defined by said elongated leg connection means and said first and second members.

14. A kit as defined in claim 13 wherein said first member comprises an upwardly directed leg which is coupled to said lower edge of said second side panel in facing relation to said inner surface, and said inner portion is releasably supported by said upwardly directed leg.

15. A kit as defined in claim 14 wherein said upwardly directed leg is coupled to said lower edge of said second side panel by a web.

16. A kit as defined in claim 14 wherein said inner panel is generally channel shaped and includes first and second legs with a web between them, one of said last named legs being for engagement with said upwardly directed leg and said other leg being for engagement with said second member.

17. A kit as defined in claim 16 wherein said flange and said inner panel include mutually engagable means from retaining said inner panel in said space.

* * * * *